US011124966B2

(12) United States Patent
Kopish et al.

(10) Patent No.: US 11,124,966 B2
(45) Date of Patent: Sep. 21, 2021

(54) WALL PANEL ANGLED CONNECTOR SYSTEM

(71) Applicant: Krueger International, Inc., Green Bay, WI (US)

(72) Inventors: Andrew J. Kopish, Green Bay, WI (US); Timothy John LaFleur, Menasha, WI (US); Nathan A. Quintal, DePere, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 16/810,430

(22) Filed: Mar. 5, 2020

(65) Prior Publication Data

US 2020/0199872 A1 Jun. 25, 2020

Related U.S. Application Data

(63) Continuation of application No. 15/490,369, filed on Apr. 18, 2017, now Pat. No. 10,626,610.

(60) Provisional application No. 62/328,083, filed on Apr. 27, 2016.

(51) Int. Cl.

| | |
|---|---|
| ***E04C 2/40*** | (2006.01) |
| ***E04B 2/00*** | (2006.01) |
| ***E04B 2/74*** | (2006.01) |

(52) U.S. Cl.

CPC ..... *E04C 2/46* (2013.01); *E04B 2/7427* (2013.01); *E04B 2/7442* (2013.01); *E04C 2/405* (2013.01); *E04B 2002/742* (2013.01)

(58) Field of Classification Search

CPC ..... E04C 2/46; E04B 2/7427; E04B 2/7429; E04B 2/7431; E04B 2/7442; E04B 2/7438

See application file for complete search history.

(56) References Cited

U.S. PATENT DOCUMENTS

| | | | |
|---|---|---|---|
| 2,311,951 | A | 2/1943 | Marshall |
| 2,855,037 | A | 10/1958 | Stiffel |
| 3,677,322 | A | 7/1972 | Brorson et al. |
| 3,809,142 | A | 5/1974 | Bleeker |
| 3,889,736 | A | 6/1975 | Firks |

(Continued)

FOREIGN PATENT DOCUMENTS

| | | |
|---|---|---|
| CA | 2407282 A1 | 4/2004 |
| CA | 2651208 | 3/2012 |

(Continued)

OTHER PUBLICATIONS

"Insulation in Joints Between Glass Panels of Mansueto Library Dome." Retrieved from https://www.flickr.com/photos/uchicagolibrary/5100360893. Website visited on Mar. 21, 2016.

(Continued)

*Primary Examiner* — Babajide A Demuren

(74) *Attorney, Agent, or Firm* — Andrus Intellectual Property Law, LLP

(57) ABSTRACT

A wall panel system includes a first wall panel, a second wall panel, and a joint member that couples the first wall panel to the second wall panel. The wall panel system also includes an upper mounting assembly that couples to the first wall panel and the second wall panel such that the upper mounting assembly pivots with the first wall panel and the second wall panel.

12 Claims, 8 Drawing Sheets

(56) References Cited

U.S. PATENT DOCUMENTS

| | | | | |
|---|---|---|---|---|
| 3,895,670 | A | 7/1975 | Bales et al. | |
| 4,129,163 | A | 12/1978 | Johnson | |
| 4,194,313 | A | 3/1980 | Downing | |
| 4,221,086 | A | 9/1980 | Berman | |
| 4,404,785 | A | 9/1983 | McCracken et al. | |
| 4,416,093 | A | 11/1983 | Salkeld et al. | |
| 4,424,654 | A | 1/1984 | Anderson et al. | |
| 4,761,922 | A | 8/1988 | Black | |
| 4,821,382 | A | 4/1989 | Puschkarski | |
| 5,193,603 | A * | 3/1993 | Whisnant | A47G 5/00 160/135 |
| 5,259,164 | A | 11/1993 | Wiese | |
| 5,287,909 | A * | 2/1994 | King | A47G 5/00 160/135 |
| 5,896,710 | A * | 4/1999 | Hoyle | E04B 1/86 160/135 |
| 6,349,517 | B1 | 2/2002 | Manley et al. | |
| 6,546,675 | B1 | 4/2003 | Adderton | |
| 6,619,008 | B1 | 9/2003 | Shivak et al. | |
| 7,090,226 | B1 | 8/2006 | Trainor et al. | |
| 7,874,090 | B2 | 1/2011 | Flagg | |
| 2001/0004817 | A1 | 6/2001 | Auer | |
| 2002/0129575 | A1* | 9/2002 | Diffrient | E04B 2/7424 52/239 |
| 2002/0129576 | A1* | 9/2002 | Diffrient | E04B 2/7431 52/239 |
| 2002/0166300 | A1* | 11/2002 | Diffrient | E04B 2/7431 52/239 |
| 2003/0005655 | A1 | 1/2003 | Lemert | |
| 2007/0107853 | A1 | 5/2007 | Hsieh | |
| 2013/0186023 | A1 | 7/2013 | Nobile | |
| 2015/0056600 | A1 | 2/2015 | Melashenko et al. | |

FOREIGN PATENT DOCUMENTS

| | | | |
|---|---|---|---|
| DE | 2248120 | A1 | 4/1973 |
| DE | 19529870 | A1 | 2/1997 |
| DE | 202012000973 | U1 | 5/2013 |
| FR | 1142411 | A | 9/1957 |
| FR | 2421585 | A1 | 11/1979 |

OTHER PUBLICATIONS

"View Into Mansueto Library Dome." Retrieved from https://www.flickr.com/photos/uchicagolibrary/5100957810/in/album-72157624620836341/. Website visited on Mar. 21, 2016.

Office Action for corresponding Canadian Patent Application No. 2,965,147 dated May 31, 2018.

Office Action for corresponding Canadian Patent Application No. 2,965,147 dated Mar. 6, 2019.

* cited by examiner

WALL PANEL ANGLED CONNECTOR SYSTEM

CROSS REFERENCE TO RELATED APPLICATION

The present application is a continuation of U.S. patent application Ser. No. 15/490,369, filed Apr. 18, 2017, which has now issued as U.S. Pat. No. 10,626,610 and is based on and claims priority to U.S. Provisional Patent Application Ser. No. 62/328,083, filed Apr. 27, 2016, the disclosures of which are incorporated herein by reference.

BACKGROUND

The present disclosure generally relates to wall panel systems. More specifically, the present disclosure relates to wall panel systems that allow adjacent wall panels to pivot relative to each other to define an angle there between.

SUMMARY

This Summary is provided to introduce a selection of concepts that are further described herein below in the Detailed Description. This Summary is not intended to identify key or central features of the claimed subject matter, nor is it intended to be used as an aid in limiting the scope of the claimed subject matter.

In certain examples, a wall panel system includes a first wall panel, a second wall panel, and a joint member that couples the first wall panel to the second wall panel.

In certain examples, a wall panel system includes a first wall panel, a second wall panel, a joint member that pivotally couples the first wall panel to the second wall panel, and an upper mounting assembly that couples to the first wall panel and the second wall panel such that the upper mounting assembly pivots with the first wall panel and the second wall.

In certain examples, a wall panel system includes a first wall panel, a second wall panel, a joint member that pivotally couples the first wall panel to the second wall panel, and an upper mounting assembly that couples to the first wall panel and the second wall panel such that the upper mounting assembly pivots with the first wall panel and the second wall panel. A first finishing member and a second finishing member are coupled to the upper mounting assembly and configured to cover the upper mounting assembly. The adjacent finishing members are coupled together by a finishing connector.

BRIEF DESCRIPTION OF THE DRAWINGS

The present disclosure is described with reference to the following Figures. The same numbers are used throughout the Figures to reference like features and like components.

DETAILED DISCLOSURE

Figure 1:
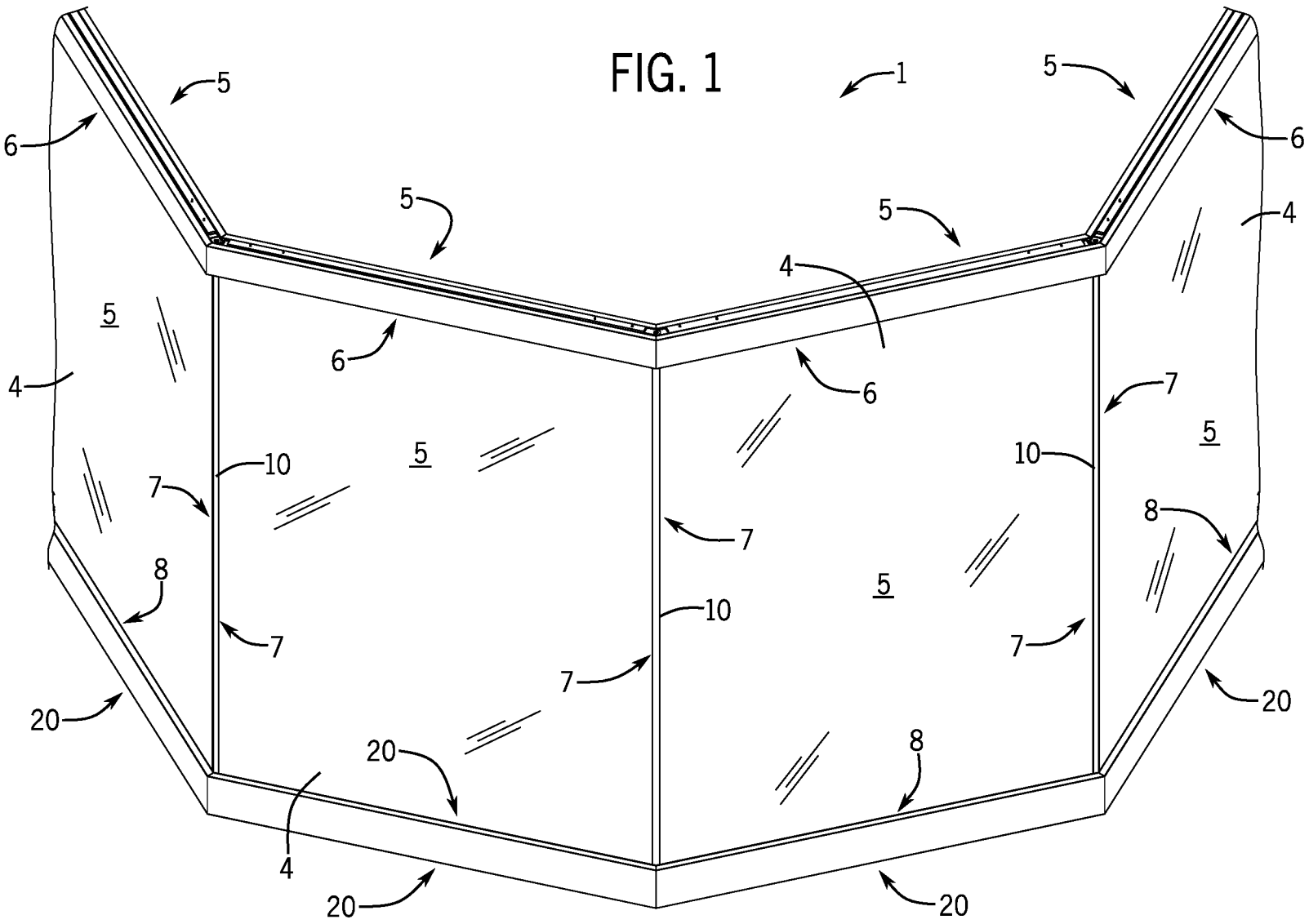
FIG. 1 is a perspective view of an exemplary wall panel system.
Figure 3:
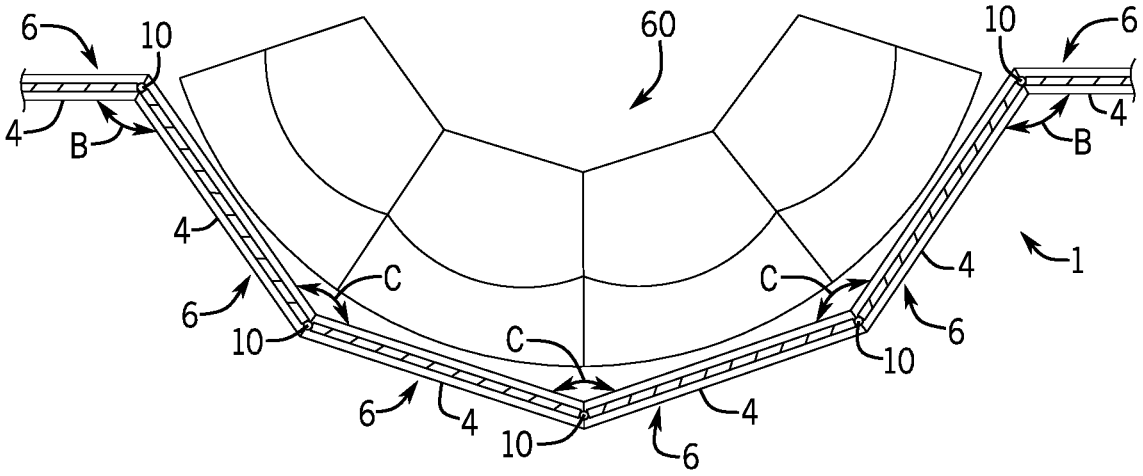
FIG. 3 is a top view of an alternative exemplary wall panel system.

FIG. 1 depicts an exemplary embodiment of a wall panel system 1 that includes a plurality of wall panels 4. Any number of wall panels 4 can be included with the wall panel system 1 (e.g. FIG. 1 depicts a wall panel system 1 with four wall panels 4; FIG. 3 depicts a wall panel system 1 with six wall panels 4). Each wall panel 4 includes an upper end 6, a lower end 8 opposite the upper end 6, a pair of side ends 7 opposite each other, and a pair of faces 5 opposite each other. The wall panels 4 are arranged such that side ends 7 of adjacent wall panels 4 are positioned adjacent to each other (i.e. the adjacent wall panels 4 are substantially positioned side end 7 to side end 7). Each side end 7 has a side surface 9 (see FIG. 5). The wall panels 4 can be made of any suitable material or combination of materials such as glass, plastic, ceramic, fabric panels, wood, metal, etc. In the embodiment shown, each of the wall panels 4 is formed from transparent glass.

Figure 2:
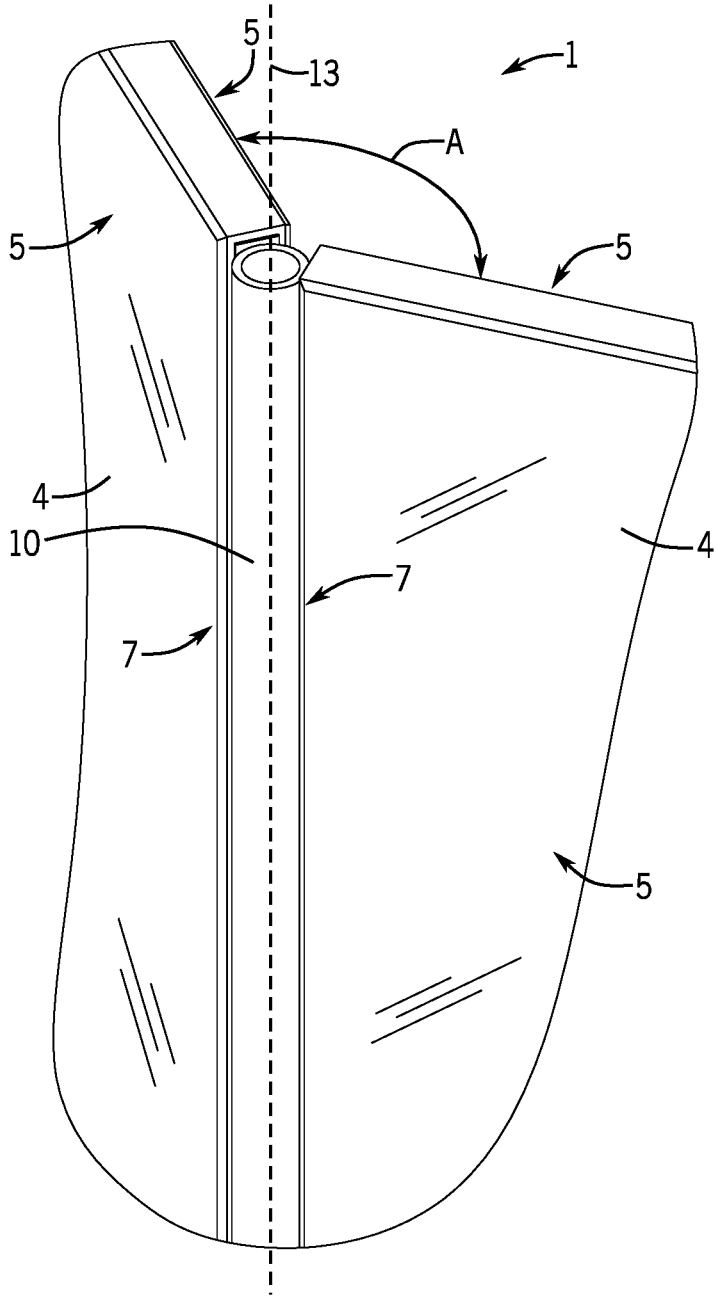
FIG. 2 is an enlarged perspective view of adjacent wall panels in an exemplary wall panel system.

Referring to FIG. 2, the wall panel system 1 includes a joint member 10 that is disposed between adjacent wall panels 4. The joint member 10 couples the adjacent walls panels 4 to each other such that the adjacent wall panels 4 can move relative to each other to thereby define an angle between the adjacent wall panels 4. The angle defined between the wall panels 4 can vary (e.g. acute, obtuse, reflex). For instance, an obtuse angle A is defined between the wall panels 4.

Figure 4:
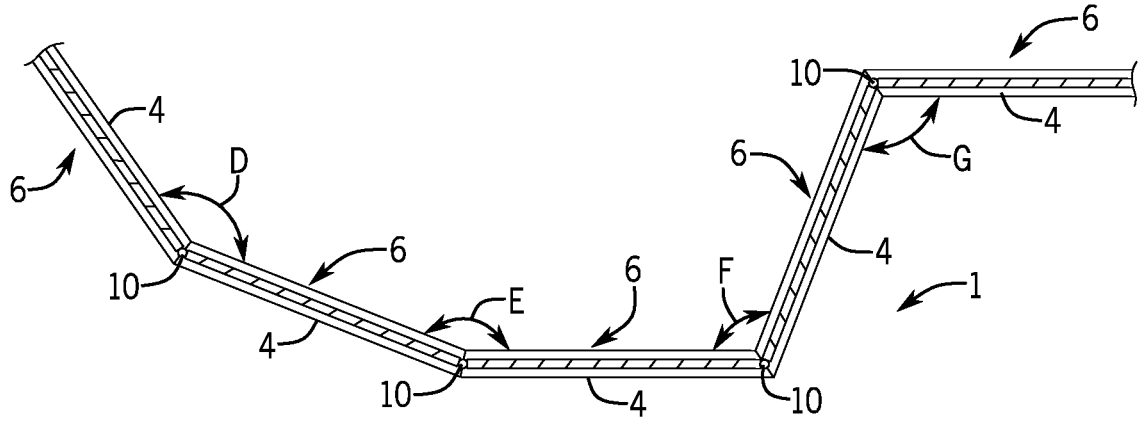
FIG. 4 is a top view of an alternative exemplary wall panel system.

Referring to FIGS. 3 and 4, top views of exemplary wall panel systems 1 are depicted. FIG. 3 depicts a wall panel system 1 that includes six wall panels 4. The wall panels 4 define angle B and angle C, respectively, and the wall panels 4 move relative to each other to accommodate the curvature of and partially surround a seating area 60, for instance. The seating area 60 can comprise any number and type of the seating furniture (e.g. sofas, chairs, loveseats). This exemplary wall panel system 1 is configured to provide some degree of privacy and/or sound control between areas and/or separate users seated in the seating area 60 from users on the side of the wall panel system 1 opposite the seating area 60. FIG. 4 depicts a wall panel system 1 with five wall panels 4 having differing angles D, E, F, G respectively, defined by the wall panels 4.

The joint member 10 can be further configured to be an anchoring point for the wall panels 4 and/or other components of the wall panel system 1, to conceal or protect the ends of the wall panels 4, and/or a combination of these. It should be known to persons of ordinary skill in the art that the joint member 10 can be positioned along the entire joint between the wall panels 4, such as between the upper end 6 of a first wall panel 4 to the lower end 8 of a second wall panel 4 (i.e. the joint member 10 couples wall panels 4 that are stacked on each other). Specifically, it is contemplated that the wall panel system 1 can be configured to form a vertically extending arch and/or dome.

The shape of the joint member 10 can vary, and in the exemplary embodiment the joint member 10 is cylindrical. The joint member 10 has an outer perimetral surface 12 that is tangential to the side surfaces 9 of adjacent wall panels 4 when the wall panels 4 are coupled to the joint member 10. The joint member 10 can extend between the upper ends 6 and the lower end 8 of the wall panels 4. Alternatively, the joint member 10 can be intermittently coupled to the side surfaces 9 of the wall panels 4. The joint member 10 defines a joint axis 13 about which the wall panels 4 pivot. The present inventors have discovered that cylindrical joint members 10 reduce assembly time, increase the lifespan, and/or reduce the overall cost of the wall panel system 1. Further, use of the cylindrical joint member 10 between adjacent wall panels 4 increases the aesthetic appearance of the wall panel system 1 (i.e. positioning the joint member 10 between the wall panels 4 aesthetically improves the visual appearance of the wall panel system 1 in comparison to a wall panel system having the side edges of the wall panels fully visible). The joint member 10 can be made of any suitable material including plastic, metal, ceramic, rubber, a clear polycarbonate material, and/or the like. In certain embodiments, the joint member 10 is preferably clear polycarbonate when the wall panels 4 are made of a transparent material (e.g. glass).

Figure 5:
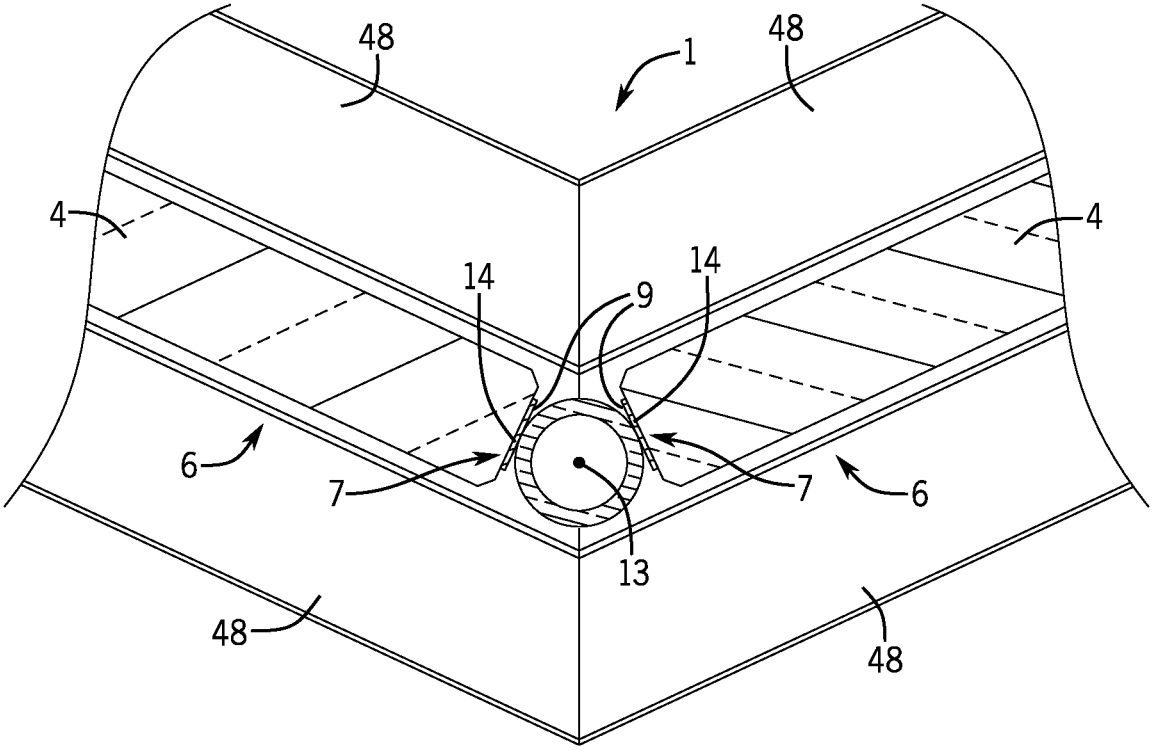
FIG. 5 is an enlarged top view of adjacent wall panels in an exemplary wall panel system.

Referring to FIG. 5 the joint member 10 is coupled to the side surfaces 9 of the wall panels 4 with a fastener 14. The fastener 14 can be any suitable material, assembly, and/or device that can couple joint member 10 to the wall panels 4 (e.g. mechanical connection, adhesives, adhesive tape). The size, shape, and material of the fastener 14 can vary.

Figure 6:
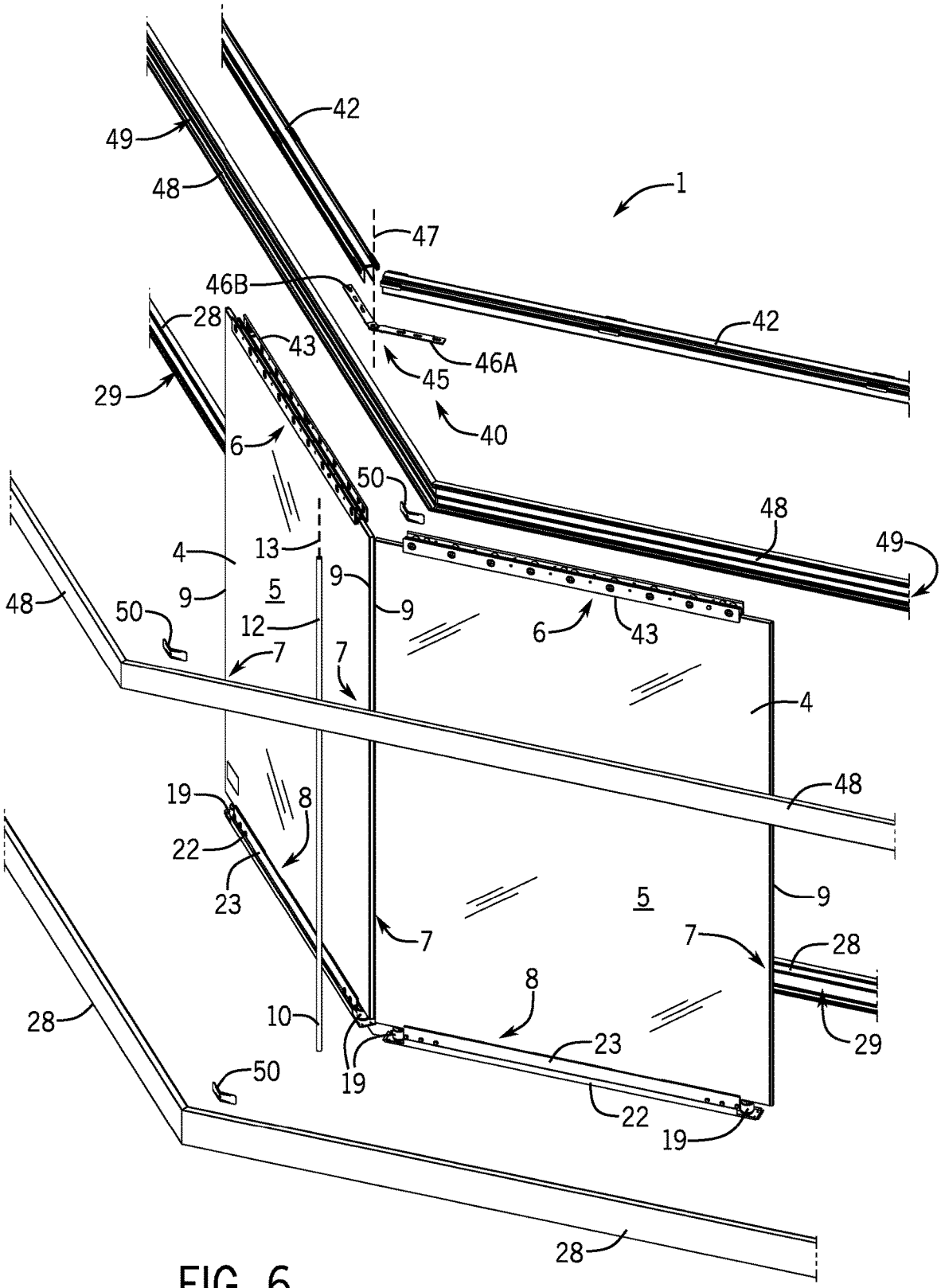
FIG. 6 is an exploded view of adjacent wall panels in an exemplary wall panel system.
Figure 7:
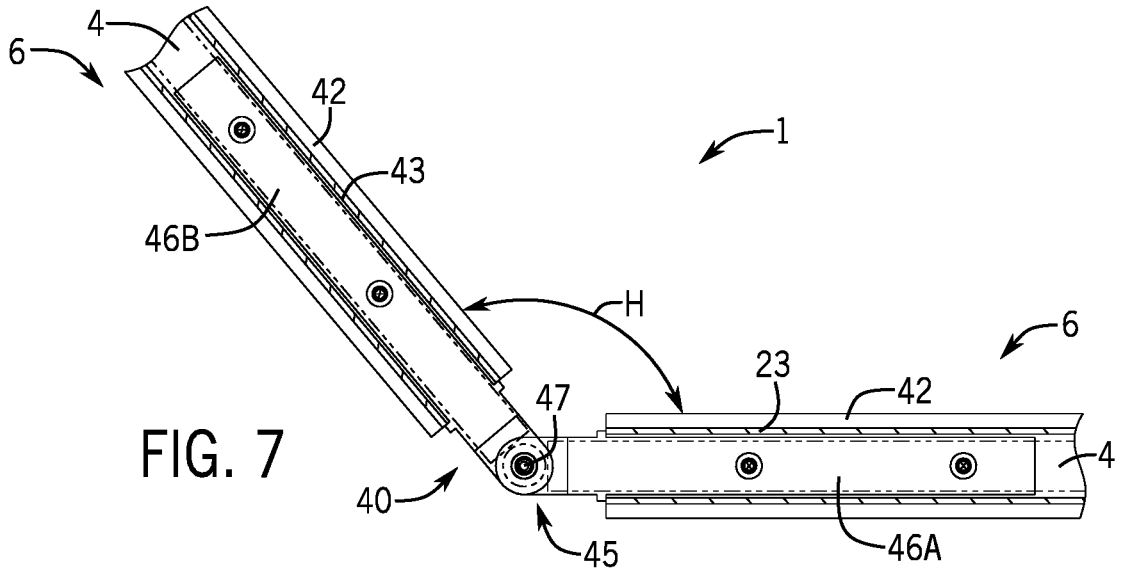
FIG. 7 is an enlarged top view of adjacent wall panels in an exemplary wall panel system.
Figure 8:
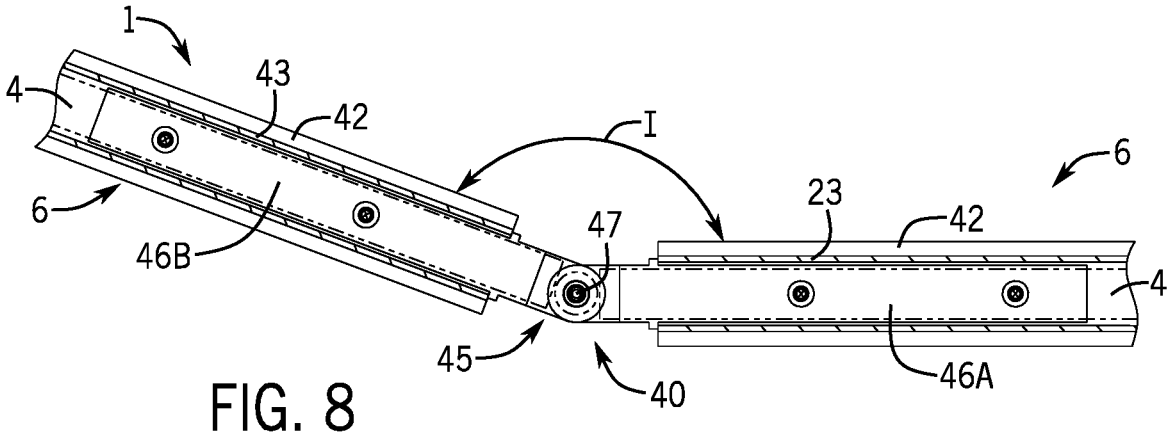
FIG. 8 is a view like FIG. 7.

Referring to FIG. 6 wall panel system 1 includes a base mounting assembly 20 that couples the lower ends 8 of the wall panels 4 together and is configured to pivot as the wall panels 4 pivot relative to each other. In certain examples, the base mounting assembly 20 is configured to vertically support the wall panels 4 on a support surface (not shown). The base mounting assembly 20 includes base members 22, base interface members 23 that include walls to receive the wall panels 4, and height adjustment devices 19. In certain exemplary embodiments, the base members 22 pivot with the wall panels 4 as the wall panels 4 pivot to define various angles there between (e.g. FIG. 7 depicts angle H defined between the wall panels 4; FIG. 8 depicts angle G defined between the wall panels 4).

Figure 9:
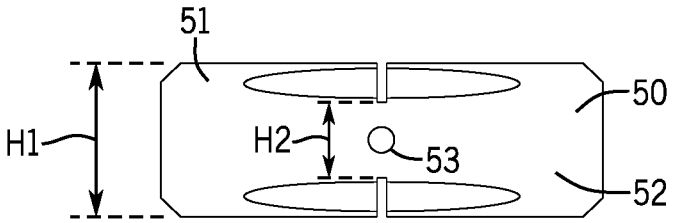
FIG. 9 is a side view of an exemplary finishing connector.
Figure 10:
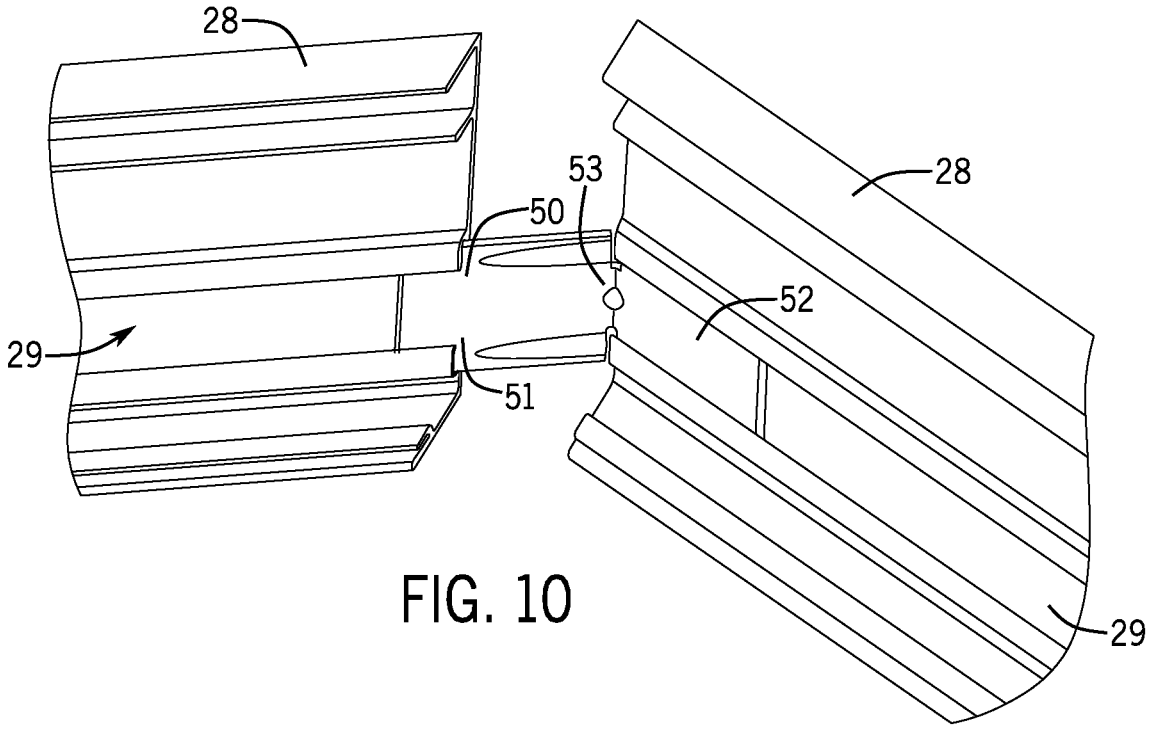
FIG. 10 is a perspective view of the finishing connector of FIG. 9 and exemplary finishing members.
Figure 11:
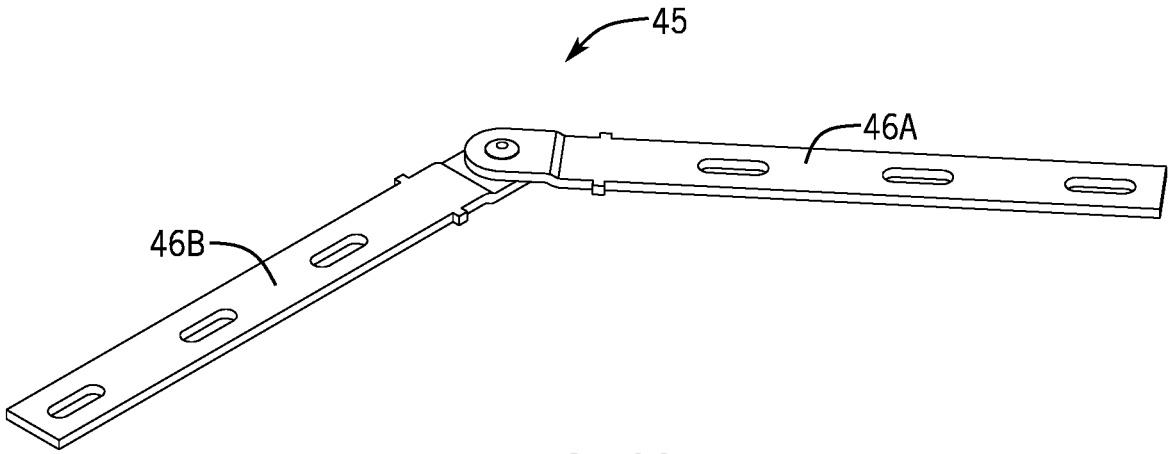
FIG. 11 is a perspective view of an example upper hinge.

Referring to FIGS. 6 and 9-10, the wall panel system 1 includes an upper mounting assembly 40 that couples the upper ends 6 of the wall panels 4 together and is configured to pivot as the wall panels 4 pivot relative to each other. The upper mounting assembly 40 includes cap members 42 and cap interface members 43 that are sandwiched between the cap members 42 and the wall panels 4. In certain examples, the cap members 42 are mounted to a support structure (e.g. ceiling, concrete wall) (not shown) which is configured to support or brace the wall panel system 1. The upper mounting assembly 40 includes an upper hinge 45 (FIG. 11), and the upper hinge 45 includes a pair of legs 46A, 46B (namely a first leg 46A and a second leg 46B) and defines an upper hinge axis 47 about which the legs 46A, 46B pivot as the wall panels 4 pivot. In an exemplary embodiment, the first leg 46A couples to a first wall panel 4 and the second leg 46B couples a second wall panel 4. In an exemplary embodiment, the upper hinge axis 47 coincides with the joint axis 13.

The wall panel system 1 includes a plurality of finishing members 28, 48 that are configured to conceal, cover, and/or protect the base mounting assembly 20 and/or upper mounting assembly 40. The finishing members 28, 48 are removably coupled to the base mounting assembly 20 and/or upper mounting assembly 40 by adhesives, mechanical connectors, and/or the like. The finishing members 28, 48 can be made of any suitable material such as metal, ceramic, wood, and/or the like. The finishing members 28, 48 can include mitered ends and adjacent finishing members 28, 48 can be coupled to each other by a finishing connector 50 (described further herein). The finishing members 28, 48 can further provide aesthetic improvement over the exposed (i.e. viewable) portions of the base mounting assembly 20 and/or upper mounting assembly 40. The size and shape of the finishing members 28, 48 can vary. In the exemplary embodiment depicted, the finishing member 28 is substantially the same length as the base member 22 of the base mounting assembly 20 (i.e. the ratio of the finishing member 28 and the base member 22 is 1:1).

Referring to FIGS. 9-10, the finishing connector 50 is a malleable member that is bendable and/or pliable. The finishing connector 50 has first end 51, a second end 52 opposite the first end 51, and a middle section 53 positioned between the first end 51 and the second end 52. The ends 51, 52 have a first height H1 and the middle section 53 has a height H2 that is less than the first height H1. The finishing connector 50 is configured to bend at the middle section 53 such that the end 51, 52 can pivot toward each other. The finishing connector 50 is formed from a light to medium-gauge metal to allow the finishing connector 50 to bend as shown in FIG. 10. FIG. 10 depicts the finishing connector 50 partially installed into adjacent finishing members 28. That is, the finishing connector 50 is received in channels 29 defined by the finishing members 28. The finishing connector 50 is received in similar channels 49 defined in the upper finishing members 48, as can be seen in FIG. 6. In other embodiments, the finishing member connector 50 is coupled to the finishing member 28, 48 by mechanical connections, friction connections, fasteners, adhesives, and/or the like.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A wall panel system comprising;

a transparent first wall panel having a side surface;

a transparent second wall panel having a side surface; and a transparent joint member having an outer perimetral surface, the transparent joint member being positioned between the side surfaces of the first and second wall panels, wherein the joint member permits adjustment of an angle defined between the first and second wall panels;

wherein the side surface of the first wall panel and the side surface of the second wall panel are each directly fastened to the outer perimetral surface, such that each side surface is tangential to and is in direct contact with the outer perimetral surface.

2. The wall panel system according to claim 1, wherein the angle defined between the first wall panel and the second wall is an obtuse angle.

3. The wall panel system according to claim 1, wherein the first and second wall panels each include an upper end and a lower end; and wherein the joint member extends between the upper ends and the lower ends.

4. The wall panel system according to claim 1, wherein the joint member is cylindrical.

5. The wall panel system according to claim 1, further comprising a base mounting assembly that vertically supports the first wall panel and the second wall panel.

6. The wall panel system according to claim 1 further comprising an upper mounting assembly including an upper hinge having a first leg coupled to the first wall panel and a second leg coupled to the second wall panel, wherein the upper hinge defines an upper hinge axis about which the first leg and the second leg of the upper hinge move relative to each other.

7. A wall panel system comprising;

a transparent first wall panel having a side surface;

a transparent second wall panel having a side surface; and a cylindrical, transparent joint member having an outer perimetral surface, the transparent joint member being positioned between the side surfaces of the first and second wall panels, wherein the joint member permits adjustment of an angle defined between the first and second wall panels; and an upper mounting assembly that couples to the first wall panel and the second wall panel such that the upper mounting assembly pivots with the first wall panel and the second wall panel as the first wall panel and the second wall panel pivot relative to each other;

wherein the side surface of the first wall panel and the side surface of the second wall panel are each directly fastened to the outer perimetral surface, such that each side surface is tangential to and is in direct contact with the outer perimetral surface.

8. The wall panel system according to claim 7, wherein the joint member defines a joint axis that coincides with the upper hinge axis.

9. The wall panel system according to claim 8, further comprising:

a first finishing member and a second finishing member each coupled to the upper mounting assembly and configured to cover the upper mounting assembly.

10. The wall panel system according to claim 8, wherein the first and second wall panels each include an upper end and a lower end; and wherein the joint member extends between the upper ends and the lower ends.

11. The wall panel system according to claim 8, wherein the upper mounting assembly has an upper hinge having a first leg coupled to the first wall panel and a second leg coupled to the second wall panel; and wherein the upper hinge defines an upper hinge axis about which the first leg and the second leg of the upper hinge move relative to each other.

12. The wall panel system according to claim 11, wherein the joint member defines a joint axis that coincides with the upper hinge axis.

* * * * *